United States Patent [19]

Arciszewski

[11] Patent Number: 4,866,902

[45] Date of Patent: Sep. 19, 1989

[54] JOINT FOR SPACE FRAME

[75] Inventor: Tomasz Arciszewski, Bloomfield Hills, Mich.

[73] Assignee: Wayne State University, Detroit, Mich.

[21] Appl. No.: 140,102

[22] Filed: Dec. 31, 1987

Related U.S. Application Data

[63] Continuation-in-part of Ser. No. 851,119, Apr. 11, 1986.

[51] Int. Cl.[4] ..... E04H 12/00

[52] U.S. Cl. ..... 52/648; 52/81; 403/171; 403/176

[58] Field of Search ..... 52/81, 648, 177; 403/171, 172, 176, 217

[56] References Cited

U.S. PATENT DOCUMENTS

| | | | |
|---|---|---|---|
| 3,864,049 | 2/1975 | Ono | 52/648 X |
| 4,090,798 | 5/1978 | Barton | 403/171 |
| 4,139,316 | 2/1979 | Svensson | 403/172 |
| 4,480,418 | 11/1984 | Ventrella | 52/648 |
| 4,562,682 | 1/1986 | Arvedi et al. | 52/648 |
| 4,624,090 | 11/1986 | Stienen | 403/172 X |
| 4,669,909 | 6/1987 | Galan Inchaurbe | 52/648 X |

*Primary Examiner*—David A. Scherbel
*Assistant Examiner*—Creighton Smith
*Attorney, Agent, or Firm*—Arnold S. Weintraub; Gerald R. Black

[57] ABSTRACT

A joint for a structural space frame. The joint includes a first, outer hollow spherical member. The first spherical member fixedly receives the ends of the components of the space frame. A plurality of second members are disposed within the interior of the first spherical member. The second members each contact the first spherical member as well as two or more adjoining second members to provide a rigid joint.

10 Claims, 1 Drawing Sheet

JOINT FOR SPACE FRAME

CROSS-REFERENCE TO RELATED APPLICATIONS

This application is a continuation application of copending U.S. patent application Ser. No. 851,119 filed Apr. 11, 1986 now pending for "Joint For Space Frame", the disclosure of which is hereby incorporated by reference.

BACKGROUND OF THE INVENTION

1. Field of the Invention

The present invention relates, in general, to space frame structures and, more specifically, to joints or connectors for space frame structures.

2. Description of the Prior Art

Structures known as space frames are well known in the building industry. Such space frames are formed of a number of struts or members which are joined at their ends at a three dimensional array. This enables a dome or arch to be constructed which covers a large area without the need for intermediate columns.

The connectors or joints between the ends of each strut are critical to the construction of the space frame. Such connections must be strong, but light in weight.

Presently, the joints take the form of a spherical body with connections for attachment of the frame members to the joint. Such spherical joints are typically solid for smaller frames and hollow for larger frames. As the number of struts per joint increase and/or the dimensions of the strut decrease, the joint must necessarily be made larger. This increases the weight of the joint and the overall space frame structure. The weight increase of the joint may be partially overcome by the use of hollow joints; but this leads to considerations concerning the wall thicknesses necessary to preserve the overall strength of the joint and space frame.

What is needed is a joint or connector for a space frame which has the features of lightweight and high strength. It would also be desirable to have such a joint or connector which provides easy connection to the adjoining frame members. Finally, it would be desirable to provide a joint or connector for a space frame which can be easily constructed in various sizes for different loads and frame configurations.

SUMMARY OF THE INVENTION

The present invention is a joint for a space frame structure which connects the ends of a number of structural frame struts or bars together in a three dimensional array. The joint is formed of a first, outer spherical body. The first spherical member is hollow and includes connections for attachment to the framework struts. The joint also includes a plurality of second members which are disposed within the interior of the first outer spherical body. Each of the second members is disposed in contact with the first outer spherical body and with two or more of the other second members such that a rigid structure is created. However, due to the voids between the second members, a lightweight joint is also created.

The second members, while preferably spherical in shape may have any other form and may also be hollow or solid depending upon the particular application. Further, the voids or spaces between the second members within the first spherical member may be filled with a material, such as, for example, a foamed plastic, to increase overall rigidity and to improve the damping response of the joint.

The joint of the present invention overcomes many of the problems encountered with previously devised joints or space frame structures in that it provides a strong and lightweight joint for such structures. The present joint is also versatile in application in that its size can be easily varied for different applications. Further several of the joints can be connected together to prove versatility in the design of the space frame.

BRIEF DESCRIPTION OF THE DRAWING

The various uses, advantages and other features of the present invention will become more apparent by referring to the following detailed description and drawing in which.

DESCRIPTION OF THE PREFERRED EMBODIMENTS

Figure 1:
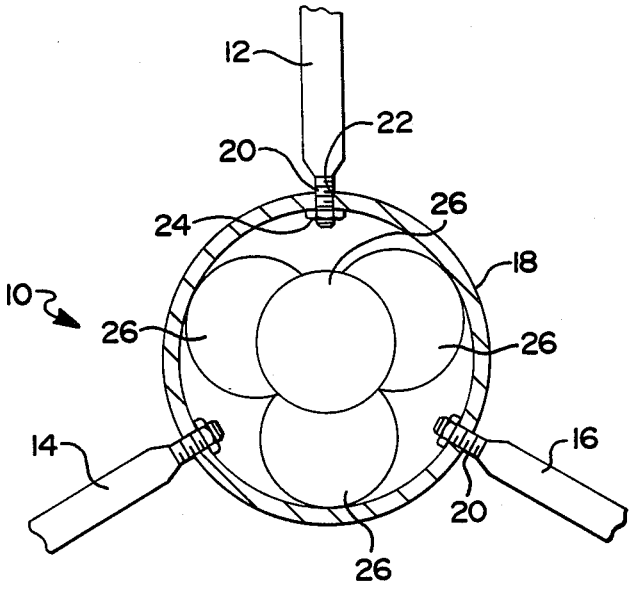
FIG. 1 is a partially sectioned view of the joint of the present invention.

Throughout the following description, an identical reference number is used to refer to the same component shown in multiple figures of the drawing.

Referring now to the drawing, and to FIG. 1 in particular, there is illustrated a joint 10 which is used to interconnect a plurality of elongated struts or bars, such as struts, 12, 14 and 16, which form a part of a structural space frame used to make domes and arches, etc. The joint enables the ends of the various struts, 12, 14 and 16, for example, to be interconnected in a three dimensional array to enable such struts to span large areas without the need for intermediate columns.

The joint 10 includes a first spherically shaped member 18. The first spherically shaped member 18 has a hollow interior. Also, the first spherical member is provided with a series of apertures 20 for receiving suitable connectors, described hereafter, for attaching the struts 12, 14 and 16 to the first spherical member 18. Any suitable connection may be employed to attach the ends of the struts 12, 14 and 16 to the first spherical member 18. By way of example only and not limitation, the ends of the struts 12, 14 and 16, such as strut 12, are provided with an internally threaded bore 22 which receives the threaded portion of a bolt 24 which is securely mounted within the interior of the first spherical member 18.

The joint or connection 10 of the present invention also includes a plurality of second members 26 which may be provided in any convenient number commensurate with the internal volume of the first spherical member 18. The second members 26 may be of hollow or solid construction depending upon the particular load requirements for each construction application. Further, while the second members are illustrated and prefer to be of spherical form, they may also be constructed in other shapes, such as oval, oblong, etc. Also, the second members are arranged within the interior of the first spherical member 18 such that their centers are at the vertices of an equilateral triangle. This places each of the second members 26 in contact with the interior surface of the first outer spherical member 18 and also in contact with two or more other second members. This results in a rigid joint structure; but which has a lightweight due to the voids existing within the interior of the first outer member 18 around the second members 26. If desired, such interior spaces may be filled with a suitable material, such as, for example, a foamed plastic, which would provide increased overall rigidity and damping of the joint and to prevent movement of the second members 26.

Figure 2:
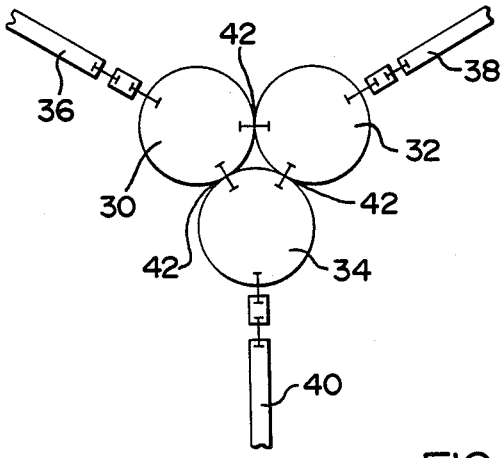
FIG. 2 is a plan view of the interconnection of the multiple joints of the present invention.

Although FIG. 1 shows the application of the joint 10 with individual connections to separate struts 12, 14 and 16, it is also possible, as shown in FIG. 2, to connect identical joints 30, 32 and 34, identical to joint 10, shown in FIG. 1, in an interconnect manner, with separate attachments to struts, 36, 38 and 40 extending outward from each of the interconnected joints 30, 32 and 34. Further, it should be noted that the individual joints 30, 32 and 34 are also connected to each other via suitable connectors 42 symbolically shown in FIG. 2. This again results in a rigid structure suitable for space frame construction applications.

The joint of the present invention is ideally suited for use in constructing space frames since it provides a rigid joint connection for the individual frame work of the space frame and yet is lightweight and can be easily adapted to different sizes depending upon loads, designs and applications.

I claim:

1. A joint for a structural framework, comprising:

(a) a plurality of elongated struts;

(b) a hollow, spherical member which carries a load;

(c) means for attaching an end of each elongated strut to the spherical member; and (d) a plurality of filler members disposed within the spherical member, the filler members being unattached to the elongated struts, a filler member being in contact with the spherical member and with another filler member, the filler members providing structural rigidity to the spherical member.

2. The joint of claim 1, wherein each filler member is in contact with the spherical member.

3. The joint of claim 1, wherein each filler member is in contact with the spherical member and another filler member.

4. The joint of claim 1, wherein each filler member is in contact with the spherical member and at least two filler members, so that the filler members comprise a rigid structure.

5. The joint of claim 1, wherein the filler members have a surface that is substantially continuous.

6. The joint of claim 1, wherein the centers of the filler members are positioned at vertices of a tetrahedron.

7. The joint of claim 1, wherein the filler members are hollow.

8. The joint of claim 1, wherein the filler members are solid.

9. The joint of claim 1, wherein a filler material is disposed in the spherical member between the spaces of the filler members.

10. The joint of claim 1, wherein the filler members are spherical.

* * * * *